US007033257B2

(12) United States Patent
Garcia et al.

(10) Patent No.: US 7,033,257 B2
(45) Date of Patent: Apr. 25, 2006

(54) CARRIER HEAD FOR CHEMICAL MECHANICAL POLISHING

(75) Inventors: Andres B. Garcia, Ocoee, FL (US); Jose Omar Rodriguez, Orlando, FL (US); Charles A. Storey, Orlando, FL (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 10/895,574

(22) Filed: Jul. 21, 2004

(65) Prior Publication Data

US 2006/0019586 A1 Jan. 26, 2006

(51) Int. Cl.
*B24B 29/00* (2006.01)
*B24B 5/00* (2006.01)

(52) U.S. Cl. ..... 451/288; 451/398

(58) Field of Classification Search ..... 451/285, 451/286, 287, 288, 289, 397, 398, 402
See application file for complete search history.

(56) References Cited

U.S. PATENT DOCUMENTS 5,876,272 A * 3/1999 Inaba et al. ..... 451/285
5,916,015 A 6/1999 Natalicio
5,931,719 A 8/1999 Nagahara et al.
6,004,193 A * 12/1999 Nagahara et al. ..... 451/285
6,012,964 A 1/2000 Arai et al.
6,056,632 A 5/2000 Mitchel et al.
6,074,289 A * 6/2000 Murakami et al. ..... 451/388
6,241,593 B1 6/2001 Chen et al.
6,273,803 B1 * 8/2001 Wang et al. ..... 451/288
6,290,584 B1 9/2001 Kim et al.
6,336,853 B1 1/2002 Schultz et al.
6,354,928 B1 3/2002 Crevasse et al.
6,361,419 B1 3/2002 Zuniga et al.
6,540,592 B1 4/2003 Schultz et al.
6,579,151 B1 * 6/2003 Tseng et al. ..... 451/11
6,645,044 B1 11/2003 Zuniga
6,659,850 B1 12/2003 Korovin et al.
6,722,964 B1 4/2004 Kimura et al.
6,722,965 B1 4/2004 Zuniga et al.
6,726,537 B1 4/2004 Crevasse et al.
6,729,946 B1 5/2004 Kimura
6,736,713 B1 5/2004 Lougher et al.

* cited by examiner

*Primary Examiner*—Jacob K. Ackun, Jr.
(74) *Attorney, Agent, or Firm*—Enrique J. Mora; Beusse, Wolter, Sanks, Mora & Maire, P.A.

(57) ABSTRACT

A carrier head for supporting a wafer during a chemical mechanical polishing process is provided. In one exemplary implementation, the carrier head may comprise a wear ring, and a slidably movable pressure plate disposed within the wear ring. The pressure plate may be arranged to provide slidable movement relative to the wear ring. This degree of freedom can accommodate height dimensional changes that may occur in the wear ring.

2 Claims, 2 Drawing Sheets

CARRIER HEAD FOR CHEMICAL MECHANICAL POLISHING

FIELD OF THE INVENTION

The present invention relates to semiconductor processing equipment, and, more particularly, to a carrier head for holding a semiconductor wafer during chemical-mechanical polishing.

BACKGROUND OF THE INVENTION

One commonly used technique for planarizing the surface of a wafer is chemical mechanical polishing (CMP). In a CMP process a wafer, as may be held by a wafer carrier head, is pressed against a polishing pad in the presence of a polishing slurry, and relative motion (rotational, orbital, linear, or a combination of these) between the wafer and the polishing pad is initiated. The mechanical abrasion of the wafer surface combined with the chemical interaction of the slurry with the material on the wafer surface ideally produces a planar surface.

As shown in FIG. 1, some known carrier heads, such as a carrier head 8, may include a flexible membrane 10 that contacts the back or unpolished surface of a wafer 12. A pressure chamber 14 may be defined in a frame 16 of the carrier head and such a pressure chamber 14 may be disposed behind the flexible membrane 10. Pressure chamber 14 is pressurized by a suitable externally connected pressurizing equipment (not shown) by way of a pressurizing port 15 so that a desired amount of compression force can be applied through membrane 10 to the back surface of the wafer to force the wafer 12 into contact with the polishing pad with a controlled pressure.

The carrier head also generally includes a wear ring 18 (sometimes referred to in the art as a "retaining ring" or "edge ring" but hereinafter referred to without limitation as a "wear ring") that may be attached to an outer periphery of frame 16 and to a corresponding portion of membrane 10 (e.g., by way of glue or mechanical attachments 21). The wear ring 18 includes a surface 19 in frictional engagement with a polishing pad 20 and is configured to support the carrier head and wafer relative to the polishing pad 20. Surface 19 of wear ring 18 can eventually experience some erosion as a function of usage. That is, the height dimension of wear ring 18 identified by line 22 will be reduced and this height reduction of wear ring 18 tends to deform the flexible membrane 10 and create a discontinuity in the pressure applied to the wafer (and to the polishing pad) at or near a gap 24 between the wafer edge and the edge of the wear ring. This may adversely affect the uniformity of the surface of the wafer being polished, particularly near the wafer edge, since the non-uniform compression near the wafer edge may cause uneven polishing at that region of the wafer.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
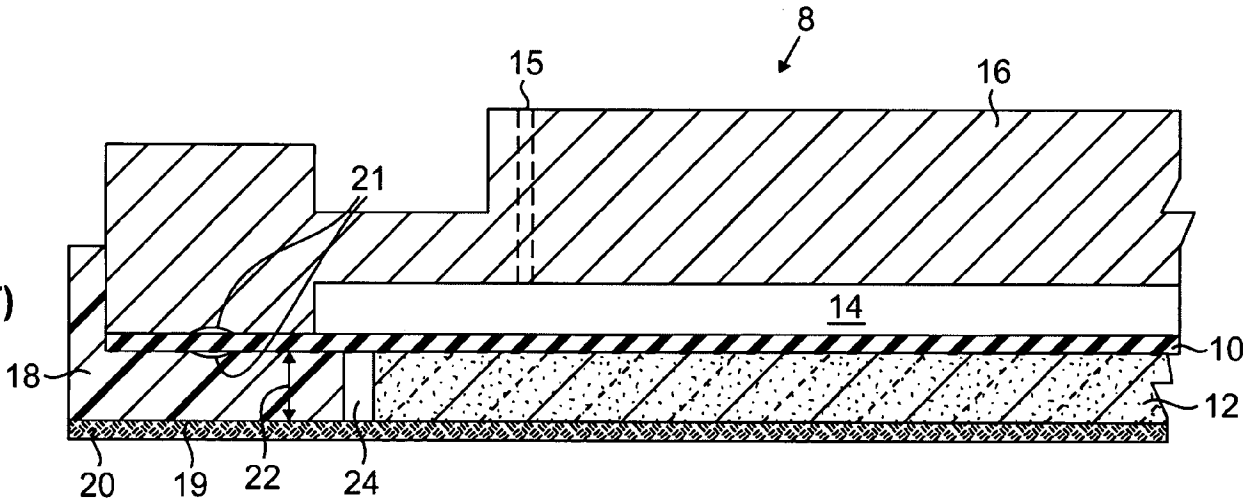
FIG. 1 (PRIOR ART)
FIG. 1 is a cross-sectional view of one known carrier head, as may be used for planarizing the surface of a wafer in a chemical mechanical polishing (CMP) process.
Figure 2:
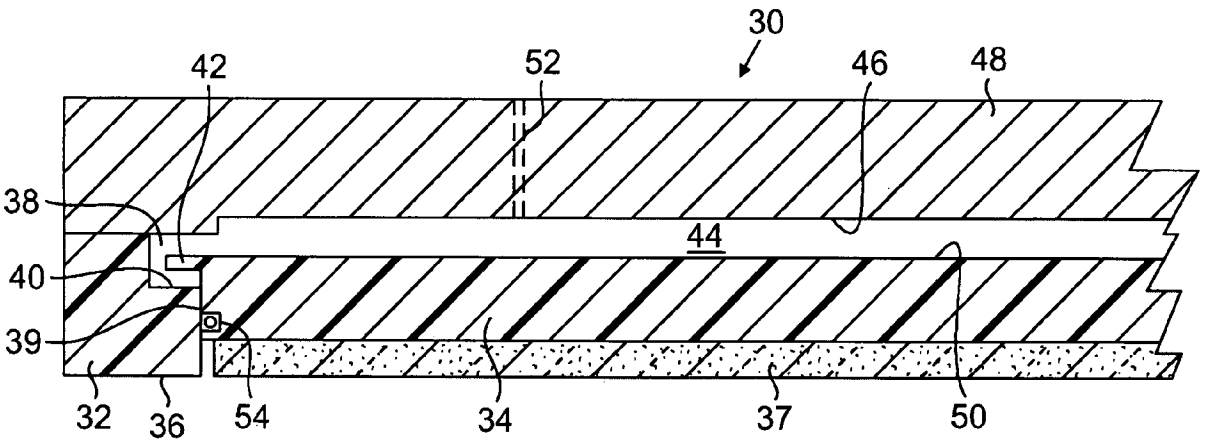
FIG. 2 is a cross sectional view of one exemplary embodiment of a carrier head embodying aspects of the present invention.

FIG. 2 is a cross sectional view of one exemplary embodiment of a carrier head 30 embodying aspects of the present invention. For purposes of simplicity of illustration, FIG. 2 takes advantage of the symmetrical characteristics of a circular structure and just illustrates one half of the cross-section of circular carrier head 30 since the other half would comprise a duplicate of the illustrated section. The inventors of the present invention have innovatively recognized low-cost and mechanically straightforward structure for avoiding or reducing effects that, as described in the context of FIG. 1, could develop as the height of a wear ring 32 becomes reduced. Thus, aspects of the present invention are directed to alleviating non-uniform compression effects that could be produced near the wafer edge as the height of wear ring 32 becomes reduced and could cause uneven polishing at that region of the wafer.

In one exemplary embodiment, carrier head 30 comprises a pressure plate 34 configured to provide slidable movement relative to wear ring 32. That is, as wear ring surface 36 becomes eroded due to frictional engagement with the polishing pad (not shown), the pressure plate 34 provides a degree of freedom that allows such a plate to slide relative to wear ring 32, thereby maintaining a substantially uniform compressive load relative to the back surface of a wafer 37, and in turn relative to the polishing pad. The pressure plate 34 may be analogized to a piston slidably moveable in a cylinder defined by inner wall 39 of the wear ring 32.

In one exemplary embodiment, wear ring 32 includes a recess 38 that in part defines a shoulder 40 positioned to engage a stop 42 constructed in the pressure plate 34. For example, engagement of stop 42 against shoulder 40 would provide a limit to downward travel of pressure plate 34, as may occur in response to pressurization buildup in a pressure chamber 44. In one exemplary embodiment, pressure chamber 44 is defined by a bottom surface 46 of a frame 48 of the carrier head. Pressure chamber 52 is further defined by a top surface 50 of pressure plate 34 and the surfaces that define recess 38. When pressure chamber 52 is pressurized by a suitable externally connected pressurizing equipment (not shown) by way of a pressurizing port 52, a compressive force is applied by pressure plate 34 against the corresponding surface of the wafer 37. In order to maintain an airtight seal in the pressure chamber 52, a seal 54 (e.g., an O-ring or other suitable sealing structure) may be provided around the pressure plate 34.

In operation, pressure plate 34 acts as a piston that, regardless of dimensional changes in the height of wear ring 32, is able to apply a substantially uniform compression force to the wafer 37. Pressure plate 34 may be made up of a sufficiently rigid material, such as steel, Teflon polymer, ceramic, polymide, relatively hard plastic or similar materials.

Figure 3:
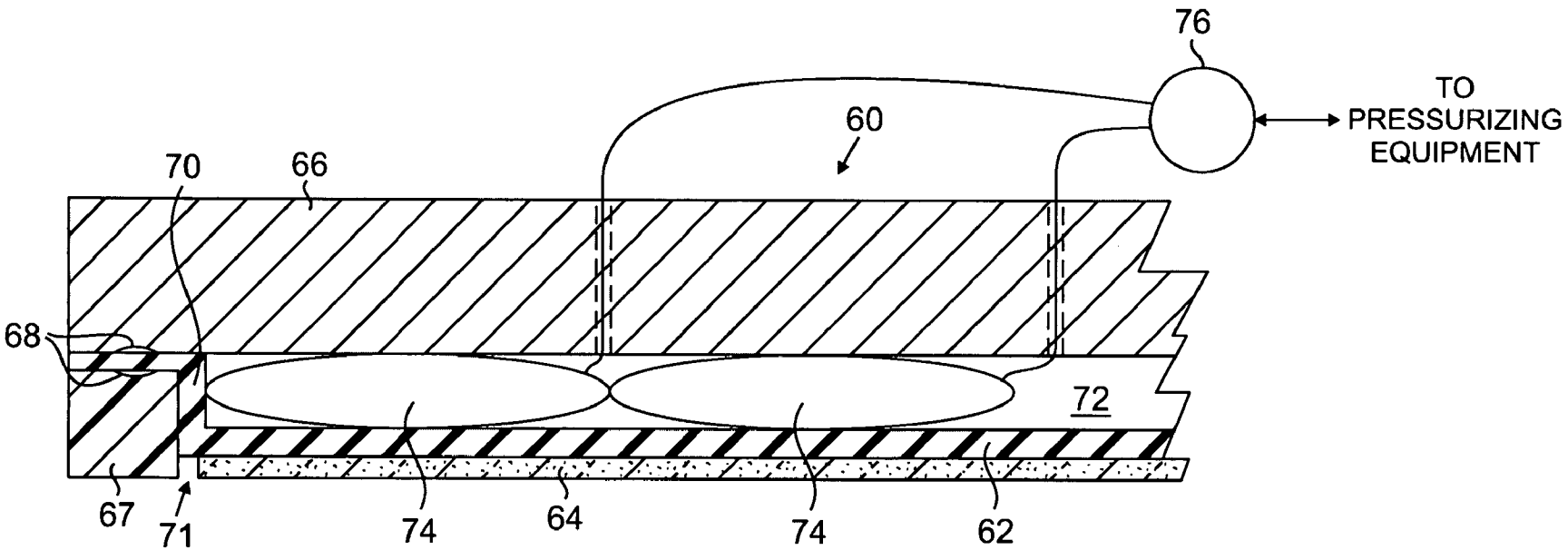
FIG. 3 is a cross sectional view of another exemplary embodiment of a carrier head embodying aspects of the present invention.

FIG. 3 is a cross sectional view of another exemplary embodiment of a carrier head 60 embodying aspects of the present invention. In this embodiment a flexible membrane 62 contacts the back or unpolished surface of a wafer 64. Flexible membrane 62 may be attached to an outer periphery of a frame 66 and to a wear ring 67 (e.g., by way of attachments 68, such as glue, epoxy, mechanical fasteners, etc.). More particularly, the flexible membrane 62 is configured to provide a preformed segment 70 (e.g., an L-shaped segment or any other shape that may provide a sufficient degree of bending relative to wear ring 67). That is, as the height of wear ring 67 becomes reduced, in lieu of creating a sharp mechanical discontinuity that tends to deform the flexible membrane 62 and create a discontinuity in the pressure applied to the wafer (and to the polishing pad), preformed segment 70 allows a gradual mechanical transition in the flexible membrane 62 at or near a gap 71 between the wafer edge and the edge of the wear ring, thereby reducing discontinuity in the pressure applied to the wafer.

A pressure chamber 72 when pressurized may function to provide a substantially constant compression force against the entire back surface of the wafer. In yet another aspect of the present invention, if optionally desired, the pressure chamber 72 may receive a plurality of inflatable bladders 74 connected by a manifold 76 to pressurizing equipment (not shown) that would allow applying a distinct (or equal) amount of pressure to the inflatable bladders. Each inflatable bladder may be analogized to a pneumatic tube in a tire. This option would provide the ability to create regions in flexible membrane 62 comprising distinct levels of compression force. The inflatable bladders may take any desired shape, such as toroidal, annular rings, concentric circles, etc. Thus, this embodiment, in addition to alleviating undesirable effects that could arise due to dimensional changes in the height of wear ring 67, may be optionally used to simultaneously apply selectably distinct levels of compression force to the wafer.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A carrier head for supporting a wafer during a chemical mechanical polishing process, said carrier head comprising:

a wear ring including a surface to be in frictional engagement with a polishing pad, wherein said wear ring includes a shoulder provided in a recess in said wear ring; and a slidably movable pressure plate disposed within said wear ring, said pressure plate adapted to provide slidable movement relative to said wear ring to account for height dimensional changes that may occur in said wear ring as a result of the frictional engagement with the polishing pad, wherein said pressure plate includes a stop configured to engage the shoulder in the wear ring to limit travel of said pressure plate relative to said wear ring, wherein said pressure plate further includes a circumferentially disposed sealing member to provide an airtight seal relative to a pressurizing chamber, and wherein said pressure plate is responsive to pressurized air in said pressurizing chamber to be coplanar with the wear ring surface and apply a uniform compression force to the wafer notwithstanding of height dimensional changes that can occur in the wear ring.

2. The carrier head of claim 1 wherein said pressure plate comprises a relatively rigid material.

* * * * *